United States Patent [19]

Bacroix et al.

[11] Patent Number: 4,787,428

[45] Date of Patent: Nov. 29, 1988

[54] CONTAINER FILLING APPARATUS WITH SELECTIVELY COMMUNICATED CHAMBERS

[75] Inventors: Marcel Bacroix, Givry; Claude Toubhans, Bry Sur Marne, both of France

[73] Assignee: Seva, Chalon sur Saone, France

[21] Appl. No.: 76,083

[22] Filed: Jul. 21, 1987

[30] Foreign Application Priority Data

Jul. 21, 1986 [FR] France ..... 86 10655

[51] Int. Cl.[4] ..... B67C 3/06

[52] U.S. Cl. ..... 141/39; 141/46; 141/198; 141/94; 141/301; 141/157; 141/140; 137/113

[58] Field of Search ..... 137/392, 412, 414, 113; 141/39, 40, 46, 59, 285, 301, 302, 307, 310, 156, 157, 158, 159, 160, 198, 140, 148–150, 94, 95

[56] References Cited

U.S. PATENT DOCUMENTS

| | | | |
|---|---|---|---|
| 3,065,775 | 11/1962 | Reves | 141/160 X |
| 3,150,697 | 9/1964 | Risser | 141/217 |
| 3,260,274 | 7/1966 | Morgan | 137/113 |
| 3,595,280 | 7/1971 | Fissel | 141/40 |
| 3,633,605 | 6/1972 | Smith | 137/113 |
| 3,905,404 | 9/1975 | Cox | 141/46 |
| 4,509,565 | 4/1985 | Alhers | 141/39 |
| 4,602,662 | 7/1986 | Eremity et al. | 141/198 |

*Primary Examiner*—Henry J. Recla
*Assistant Examiner*—Ernest G. Cusick
*Attorney, Agent, or Firm*—Sughrue, Mion, Zinn, Macpeak and Seas

[57] ABSTRACT

Liquid from a supply tank B flows into a container C via outer and central annular chambers 14, 8 of filling apparatus A. Communication between the chambers is controlled by a flexible diaphragm 5 selectively urged against an annular seat 15 on a wall 10 separating the chambers in response to air pressure supplied to a chamber 23 on an opposite side of the diaphragm.

4 Claims, 4 Drawing Sheets

CONTAINER FILLING APPARATUS WITH SELECTIVELY COMMUNICATED CHAMBERS

BACKGROUND OF THE INVENTION

This invention relates to an apparatus for filling containers with noncarbonated liquids and having a separate air return, thereby avoiding any contamination of the liquid being bottled by the air removed from the container during the filling process.

The prior art teaches various filling devices in which the air in the bottle or container is removed through a vent without being returned to the liquid supply tank. However, known devices of this type involve losses of the liquid being bottled that are not tolerable when the commercial value of the liquid is high. Furthermore, such devices are mechanically operated using sliding joints which, in addition to problems of mechanical construction, pose considerable problems of bacterial growth.

SUMMARY OF THE INVENTION

This invention thus provides an apparatus for filling containers with noncarbonated liquids that is simple to produce, by reducing the number of parts needed for its manufacture, and aseptic, while simultaneously maintaining an acceptable rate at which containers can be filled. The apparatus includes central and outer annular chambers selectively communicated by a flexible diaphragm engageable with an annular seat on a wall separating the chambers in response to air pressure on the opposite side of the diaphragm.

DETAILED DESCRIPTION OF THE PREFERRED EMBODIMENTS

Figure 1:
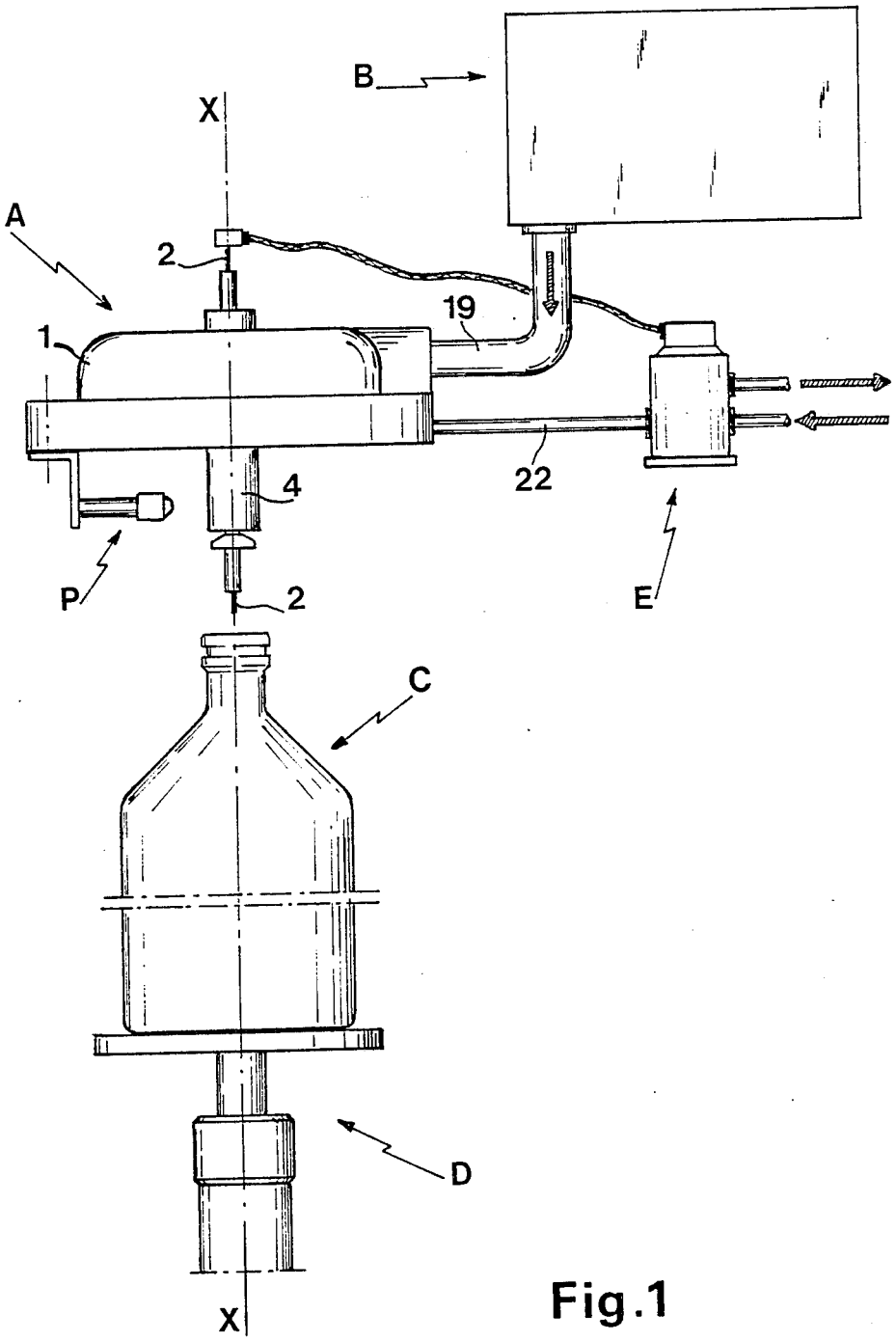
FIG. 1 is an overall view of an installation comprising the filling apparatus of the invention.

In the embodiment shown in FIG. 1, filling apparatus A of the invention is designed to fill a container C, made of plastic or other material and supported by raising means D, with liquid from a supply tank B.

Figure 2:
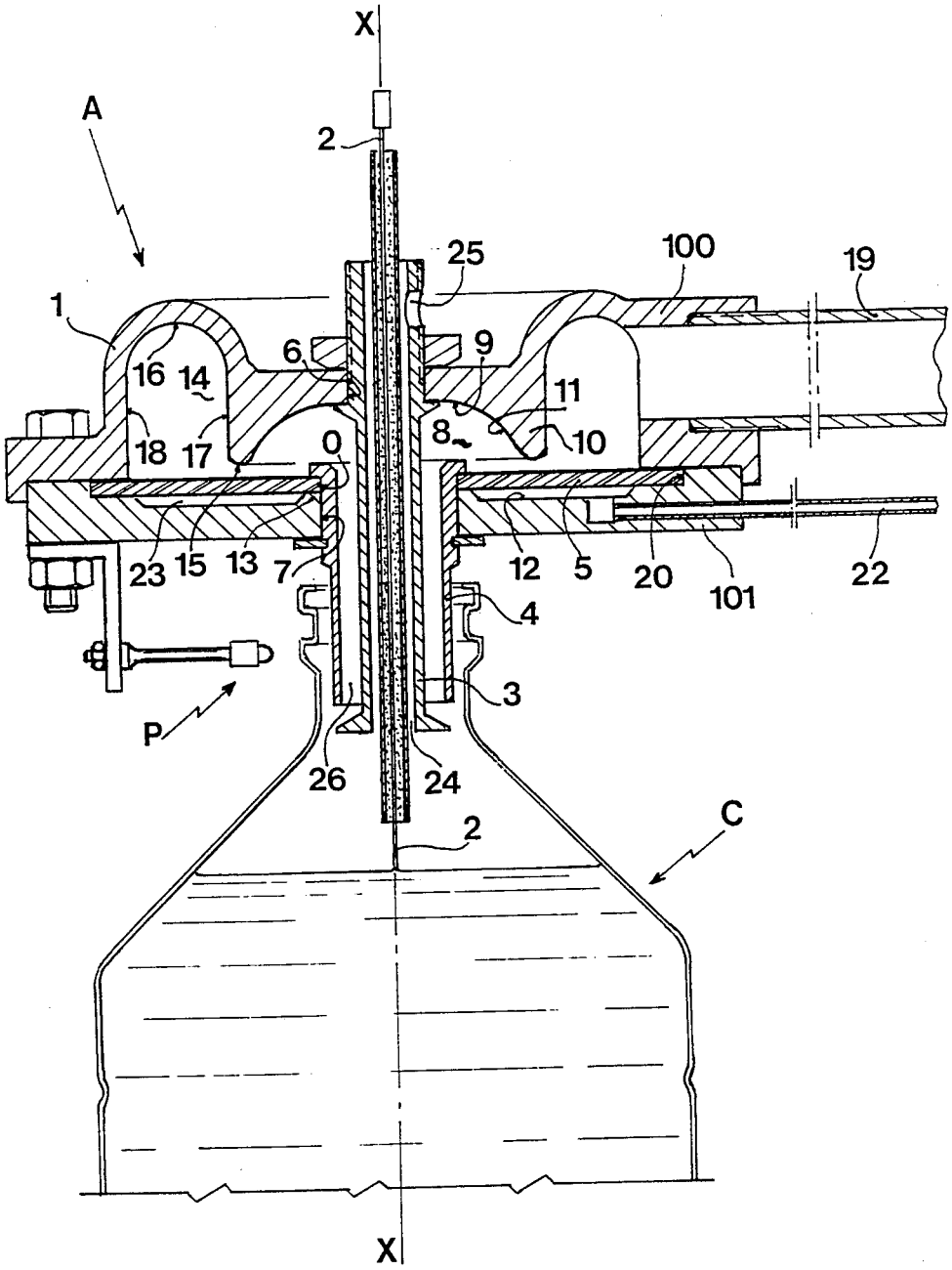
FIG. 2 is a cross-section of the filling apparatus of FIG. 1.

As illustrated in FIG. 2, filling apparatus A consists of a body 1 having axis X—X, an electric sensor 2 coaxial with and pasing through body 1 from top to bottom, a coaxial sleeve 3 for the evacuation of air from the container C, a liquid flow sleeve 4, and a membrane 5 made of an elastomer or another flexible material. The membrane 5 preferably consists of a circular washer with axis X—X containing a coaxial, circular, center hole 0.

Body 1 contains a coaxial opening 6 in its upper surface, and a coaxial lower opening 7. Openings 6 and 7 lead into a central chamber 8 bounded by a ceiling consisting of an annular surface 9 joining a vertical wall 10 across a surface of revolution 11 forming the periphery of the coaxial central chamber 8. Below, the chamber is bounded by a floor 12 that meets lower opening 7 across a shoulder 13.

The central chamber 8 communicates with a coaxial peripheral chamber 14 through an annular passageway between a lower surface or seat 15 of wall 10 and floor 12, which exeends radially beyond the wall 10. At its upper end the chamber 14 is bounded by an annular surface 16. In the embodiment shown in FIG. 2, the cross-section of surface 16 is curved, but it could be straight. Inward toward axis X—X, surface 16 meets a surface of revolution 17. Together with surfaces 15 and 11, the surface 17 forms wall 10. At its outer periphery the annular chamber 14 is bounded by a surface of revolution 18 extending between floor 12 and the ceiling surface 16. A tube 19 empties into chamber 14, connecting the latter with liquid supply tank B.

Thus, filling apparatus A has a body 1 consisting of a central chamber 8 with vertical axis X—X that communicates with a peripheral chamber 14 through an annular passageway created between (i) the wall 10 separating central chamber 8 from peripheral chamber 14 and forming seat 15, and (ii) a floor surface 12 in the central chamber that extends radially beyond wall 10 into the peripheral chamber.

Near floor 12, an annular groove 20 is provided in the periphery of surface 18 between floor 12 and the opening of tube 19 into peripheral chamber 14. This annular groove corresponds to a mold line between upper section 100 and lower section 101 of body 1.

In addition, a conduit 22 opens into peripheral chamber 14 or into central chamber 8 through floor 12. The conduit 22 is connected through a solenoid valve E to a source of pressurized gas (not shown).

Sleeve 4, extending from shoulder 13 and through opening 7, provides a means of fastening the inner edge of membrane 5 against the shoulder. The outer edge of membrane 5 is set in the annular groove 20.

The seat surface 15 of wall 10 is located halfway between shoulder 13 and groove 20. A gap of a few millimeters is provided between the upper surface of membrane 5 and surface 15. Thus, as shown in FIG. 2, membrane 5, set within peripheral chamber 14 and extending radially toward axis X—X beyond wall 10, forms together with floor surface 12 a deformable annular chamber 23.

Sleeve 3, fastened in a leaktight manner to body 1 at the opening 6, extends downward through sleeve 4 to a level below that of sleeve 4. Electric sensor 2 passes through sleeve 3 from top to bottom. An annular conduit 24 is defined between sensor 2 and the inside surface of sleeve 3. The conduit 24, whose lower end opens at a point below sleeve 4, vents to the atmosphere at its upper end through opening 25. Because the internal diameter of sleeve 4 is greater than the external diameter of sleeve 3, an annular channel 26 connects central chamber 8 with the exterior of filling apparatus A.

Finally, a sensor P for detecting the proximity of the container C that is to be filled may be attached to filling apparatus A. In the embodiment shown in FIG. 1, detector P is fastened to body 1, but it might also be independent thereof, and be placed instead on raising means D.

Figure 3:
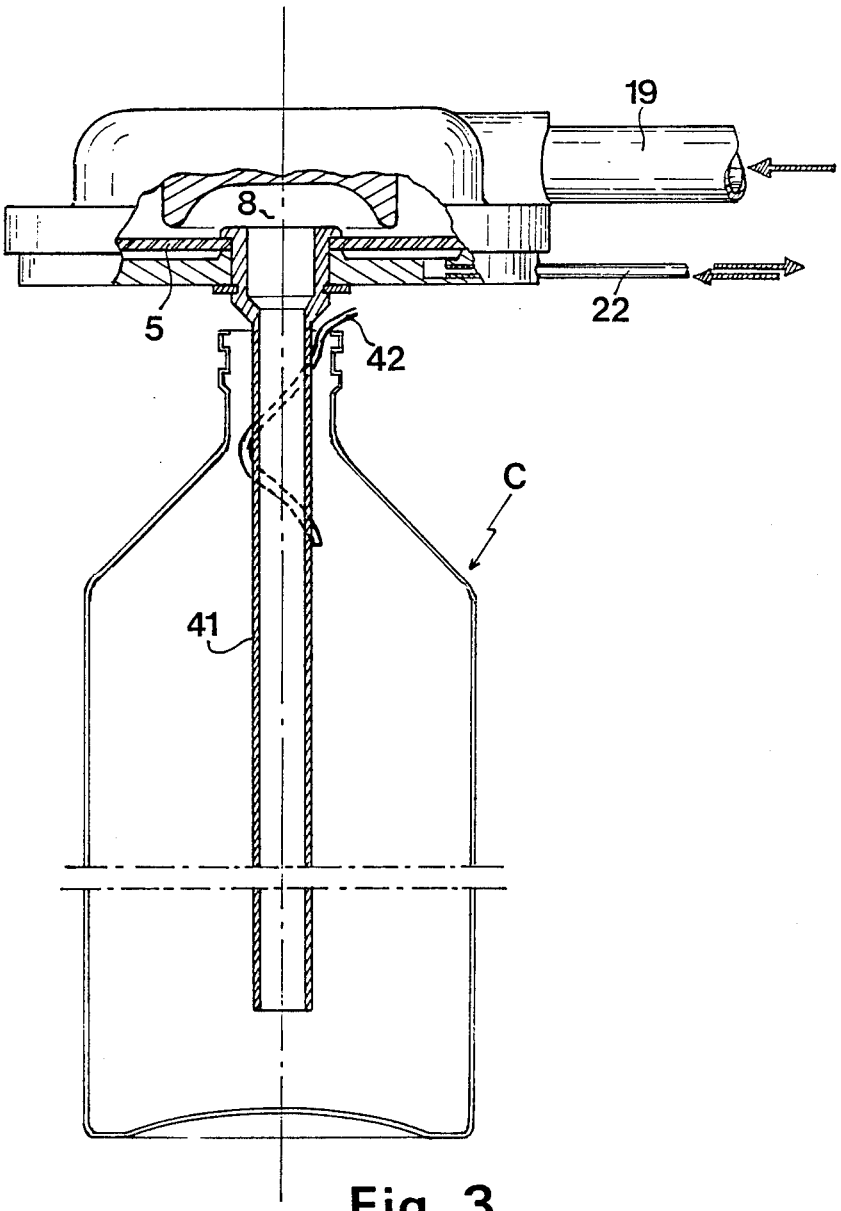
FIG. 3 is a partial cross-section of a first variant of the filling apparatus of the invention.

The variant shown in FIG. 3 represents an adaptation of the invention to a filling device equipped with a long, hollow needle. In this variant, sleeve 3 and sensor 2 have been eliminated and opening 6 has also disappeared. Furthermore, sleeve 4 has been replaced by a long, hollow needle 41 made of a nonconducting material, onto the outside of which is fastened a sensor 42.

Figure 4:
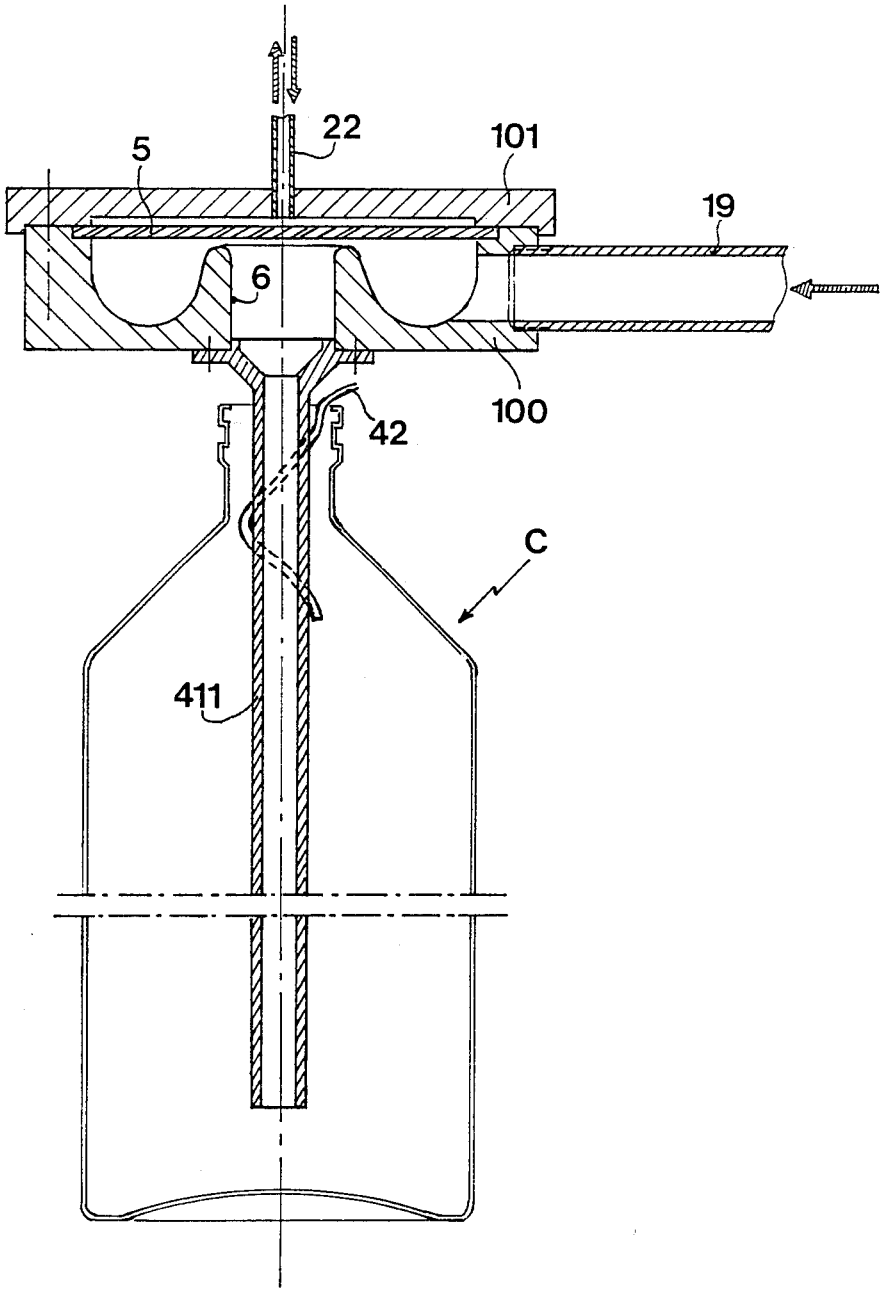
FIG. 4 is a cross-section of a second variant of the filling apparatus.

In the variant shown in FIG. 4 sections 100 and 101 of body 1 have been inverted. Thus, opening 7 has been eliminated and a long, hollow needle 411 has been fastened to opening 6 and equipped with a sensor 42. Membrane 5 no longer contains a central hole 0.

In a rest condition, i.e., when no container C is being filled, pressurized air forced through conduit 22 into annular chamber 23 by solenoid valve E presses membrane 5 against seat 15 of wall 10. Therefore, the liquid being bottled, flowing into peripheral chamber 14 through tube 19, cannot flow through central chamber 8 and annular conduit 26 into a container C.

When raising means D lifts container C to a point at which sleeve 4 enters the neck of the container and the latter seats against the underside of the filling apparatus, proximity detector P triggers solenoid valve E which causes the pressure in annular chamber 23 to drop. With membrane 5 no longer touching seat 15 of wall 10, peripheral chamber 14 is placed in communication with central chamber 8. Liquid may then flow into container C through the annular conduit 26 formed by the inner surface of sleeve 4 and the outer surface of sleeve 3. The air trapped in the container is able to escape through opening 25 via annular conduit 24 formed between sleeve 3 and sensor 2. Thus, the air in the container being filled is not removed to the liquid supply tank, nor is any of the liquid being bottled lost in the cours of the operation.

When the liquid reaches the level of sensor 2, the latter triggers solenoid valve E, which repressurizes annular chamber 23, causing membrane 5 to be pressed once more against seat 15 of wall 10. The filling of container C is then complete and a new cycle may begin.

Using the apparatus of the invention, the filling operation is accomplished under highly hygienic conditions created by the separate return of air and the absence of moving parts, and thus of joints, which constitute breeding grounds for bacteria. Washing the apparatus is very simple, since one simply cuts off the supply of pressurized gas to annular chamber 23, thus opening the passage between the chambers and placing the apparatus in a condition to be washed. In addition, the apparatus entails no loss of liquid since, by its very principle, the feed is stopped as soon as the necessary quantity of liquid has been provided.

Furthermore, the FIG. 2 embodiment works perfectly, even in the absence of leaktight contact between the neck of container C being filled and filling means A. In the FIGS. 3 and 4 variants the container neck is not seated against the underside of the filling apparatus, and the air simply exits through the open neck. Finally, since only a few cubic centimeters of air are required in annular chamber 23 under membrane 5 in order to close the annular passage between chambers 8 and 14, the apparatus has a shut-off time on the order of 20 milliseconds despite the fact that pneumatic means are usually deemed to be slow.

What is claimed is:

1. An apparatus for filling containers (C) with non-carbonated liquids, comprising:

(a) a housing (1), (b) a central chamber (8) defined within the housing, and having a fill tube (4; 41; 411) extending downwardly therefrom and in open communication therewith, (c) a peripheral chamber (14) defined within the housing, surrounding the central chamber, (d) an annular wall (10) defined by the housing for separating the central and peripheral chambers, and defining an annular seat (15) on an axially extending edge thereof, (e) a flexible diaphragm (5) sealingly mounted within the housing and confronting the seat on one side thereof to define therewith an annular passage for selectively communicating the central and peripheral chambers, (f) a control chamber (23) defined within the housing on another, opposite side of the diaphragm, (g) means (19) for supplying liquid to be filled into a container to the peripheral chamber, (h) means (D) for positioning a container to be filled below the housing with a neck of the container surrounding the fill tube, extending downwardly from the central chamber and in open communication therewith, and (i) means (E, 22) for supplying pressurized fluid to and exhausting pressurized fluid from the control chamber to urge the diaphragm against and away from the seat to selectively close and open the annular passage, and (j) a proximity sensor (P) disposed proximate the fill tube for sensing the presence of the container neck, and having an output connected to the pressurizd fluid supplying and exhausting means for controlling the opening of the annular passage.

2. An apparatus according to claim 1, further comprising a liquid level sensor (2; 42) disposed proximate the fill tube for sensing the filling of the container, and having an output connected to the pressurized fluid supplying and exhausting means for controlling the closing of the annular passage.

3. An apparatus according to claim 1, further comprising an exhaust passage (24) coaxially defined within the fill tube and extending upwardly through the central chamber and a top of the housing to allow the escape of air displaced by liquid being filled into the container.

4. An apparatus for filling containers (C) with non-carbonated liquids, comprising:

(a) a housing (1), (b) a central chamber (8) defined within the housing, and having a fill tube (4; 41; 411) extending downwardly therefrom and in open communication therewith, (c) a peripheral chamber (14) defined within the housing, surrounding the central chamber, (d) an annualar wall (10) defined by the housing for separating the central and peripheral chambers, and defining an annular seat (15) on an axially extending edge thereof, (e) a flexible diaphragm (5) sealingly mounted within the housing and confronting the seat on one side thereof to define therewith an annular passage for selectively communicating the central and peripheral chambers, (f) a control chamber (23) defined within the housing on another, opposide side of the diaphragm.

(g) means (19) for supplying liquid to be filled into a container to the peripheral chamber, (h) means (D) for positioning a container to be filled below the housing with a neck of the container surrounding the fill tube, (i) means (E, 22) for supplying pressurized fluid to and exhausting pressurized fluid from the control chamber to urge the diaphragm against and away from the seat to selectively close and open the annular passage, and (j) an exhaust passage (24) coaxially defined within the fill tube and extending upwardly through the central chamber and a top of the housing to allow the escape of air displaced by liquid being filled into the container.

* * * * *